United States Patent [19]

Ishihara et al.

[11] Patent Number: 4,598,761

[45] Date of Patent: Jul. 8, 1986

[54] VERTICAL TYPE CONTINUOUS CASTING APPARATUS HAVING A TORCH CUTTER

[75] Inventors: Yoshinobu Ishihara, Osaka; Kazuya Minami; Shuntaro Matsumoto, both of Hyogo, all of Japan

[73] Assignee: Kabushiki Kaisha Kobe Seiko Sho, Kobe, Japan

[21] Appl. No.: 566,703

[22] Filed: Dec. 29, 1983

[51] Int. Cl.[4] ..... B22D 11/126; B23K 7/02

[52] U.S. Cl. ..... 164/263; 164/426; 164/446; 164/460; 266/49; 266/50

[58] Field of Search ..... 164/263, 460, 69.1, 164/446, 426; 266/50, 49

[56] References Cited

U.S. PATENT DOCUMENTS

| | | | |
|---|---|---|---|
| 3,428,112 | 2/1969 | Cuscino | 164/263 |
| 3,525,383 | 8/1970 | Golde | 164/263 |
| 3,650,315 | 3/1972 | Abarotin et al. | 164/263 X |
| 3,971,429 | 7/1976 | Horeth | 164/446 X |
| 4,143,860 | 3/1979 | Herbener et al. | 266/50 X |

FOREIGN PATENT DOCUMENTS

| | | | |
|---|---|---|---|
| 2927311 | 1/1981 | Fed. Rep. of Germany | 266/49 |

*Primary Examiner*—Nicholas P. Godici
*Assistant Examiner*—J. Reed Batten, Jr.
*Attorney, Agent, or Firm*—Oblon, Fisher, Spivak, McClelland & Maier

[57] ABSTRACT

A gas cutting machine for cutting a cast strand includes a torch and is movable downward together with a cut portion of the cast strand. In the neighborhood of the torch is located a movable hood which is movable in synchronism with vertical lifting operation of the gas cutting machine, and an expansible sludge discharge pipe and an expansible suction duct communicated with a suction blower are mounted on the movable hood. A divisional dummy bar is utilized and includes an upper and lower divisional dummy bar, and a connector for connecting the divisional dummy bars together. The connector comprises an upper member and a lower member, the upper member having in its inner cavity a pair of levers pivotally supported on lever shafts and the lever havign a locking roller at the lower end thereof. The lower member includes a hooking head held by a pair of locking rollers.

12 Claims, 7 Drawing Figures

VERTICAL TYPE CONTINUOUS CASTING APPARATUS HAVING A TORCH CUTTER

BACKGROUND OF THE INVENTION

1. Field of the Invention

The present invention relates to a vertical type continuous casting apparatus and more particularly to a vertical type continuous casting apparatus which comprises a movable hood for discharging iron oxide sludge and combustion gases generated when a continuous cast strand is cut by gas at the lower portion of the apparatus and a divisional dummy bar is used when continuous casting operation begins.

2. Description of the Prior Art

In the vertical type continuous casting apparatus, a continuous cast strand moved down by pullout pinch rolls within a lower caisson is cut by a gas cutting machine to deliver the cut cast strand by means of an ejecting device. In the gas cutting machine, high pressure oxygen is blown mainly towards a high temperature continuous cast strand to cut it by oxidization, and therefore a cut width of about 10 to 15 mm, which differs with the dimension of a torch, is produced. This cut width portion is formed into an iron oxide scale, which is blown off to generate sludge.

In the past, a vertically lengthy, open, fixed hood is provided over the entire width of a vertically moving stroke of the gas cutting machine so as to recover generated sludges. The hood is communicated with a duct for discharging, by a suction blower, gases generated as cutting takes place. However, since the open area of the hood is large, the capacity of the blower needs to be increased. In addition, the efficiency of recovery of the sludge is not sufficient and a part of the sludge is scattered and accumulated in the periphery so as to impair the operation of devices located lower, and, therefore, continuous operation has to be suspended for cleaning. This results in an unavoidable reduction in productivity, particularly in case of so-called continuous casting in which casting from a plurality of ladles is possible so as to allow for continuous casting. The conventional fixed hood is not only low in performance but high in manufacturing cost, resulting in an increase in construction cost of the continuous casting apparatus.

Moreover, it is necessary that when continuous casting operation begins, a bar having the same sectional shape as that of a product and which is called a dummy bar is placed on a bottom of a mould to remove molten metal while being integrally attached to the dummy bar to continue the casting operation.

Where the dummy bar is of an integral type and a lower insertion system is used as a system for inserting a dummy bar into a water-cooled mould, an underground pit, called a caisson is used, whereas where an upper insertion system is used, a house and a crane become highly elevated. Each system requires a relatively high cost of equipment.

One solution is to use a divisional dummy bar so that these sections may be removed successively. However, in the vertical type continuous casting, a dummy bar is downwardly inserted into a mould by plural groups of pinch rolls and the weight of a continuous cast strand and the weight of the dummy bar are balanced to remove the continuous cast member from the mould, and therefore, the division itself of the dummy bar is restricted in terms of relation with the pinch rolls. Furthermore, with respect to means for connecting the divisional dummy bar, there is posed a problem in terms of difficulty in construction to meet requirements, at the same time, such as positive passage of the dummy bar through roll portions, and positive connection to prevent unexpected disengagement when an easy disengagement feature is necessary. Therefore, there have been disadvantages in that the continuous casting apparatus increases in scale and equipment costs also increase.

SUMMARY OF THE INVENTION

In the vertical type continuous casting apparatus according to this invention, a movable hood provided in the neighborhood of a torch of a gas cutting machine which is moved down with a cast strand to cut the cast strand is moved downward in synchronism with the downward movement of the gas cutting machine to discharge sludge and combustion gases outside. Divisional dummies are connected by connectors and hooking heads provided on a lower member are held by locking rollers provided on the extreme ends of a pair of levers in an upper member constituting the connector for connection thereof such that dividing of the dummy bar is accomplished by pushing-in the upper end of the lever.

It is an object of the present invention to provide a vertical type continuous casting apparatus which is compact in its whole structure and low in equipment cost.

It is a further object of the invention to provide a vertical type continuous casting apparatus which can smoothly continue continuous casting operation and enhance the productivity of the continuous casting apparatus.

It is another object of the invention to provide a vertical type continuous casting apparatus which can eject lengthy cut cast strand.

It is still another object of the invention to provide a vertical type continuous casting apparatus comprising a movable hood which is high in efficiency in collecting sludge and has a small gas discharging suction blower capacity.

It is another object of the invention to provide a simple vertical type continuous casting apparatus having an intensive structure in which means for synchronously downwardly moving a movable hood is used and which is common to a gas cutting machine.

It is another object of the invention to provide a vertical type continuous casting apparatus which can allow the caisson to be shallow and the house to be low.

It is another object of the invention to provide a vertical type continuous casting apparatus which is positive in separation and connection operations without occurrence of accidental release of a lower dummy bar and which is both easy to use in operation and simple in construction.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
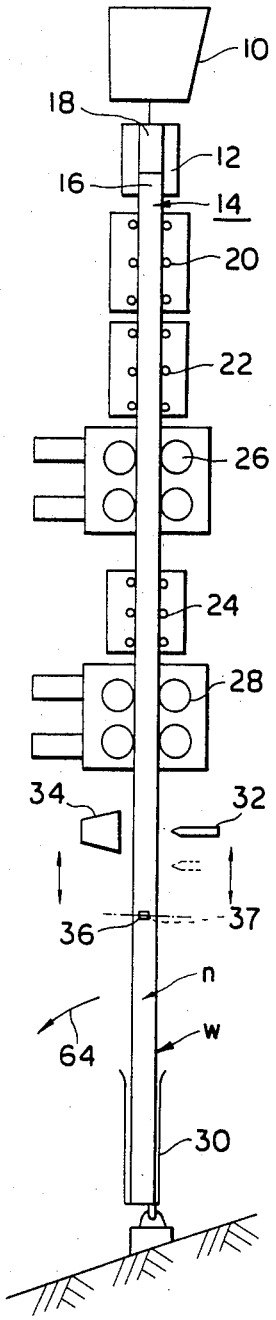
FIG. 1 is a side view schematically showing a vertical type continuous casting apparatus in accordance with this invention.

FIG. 1 schematically shows the outline of the whole construction of a vertical type continuous casting apparatus in accordance with the present invention. A water-cooled mould 12 is provided downwardly of a tundish 10. A head 16 of a divisional dummy bar 14 is inserted into a lower portion within the water-cooled mould 12 to initially interrupt downward flow of molten metal cast from the tundish 10 until walls of an outer shell begin to be solidified to form a continuous cast strand 18. Reference numerals 20, 22 and 24 denote secondary cooling guide rolls. The divisional dummy bar 14 is pulled out downwardly from pulling-out pinch rolls 26, 28 is, and received in an ejecting device 30 of a tiltable basket type provided at the lowermost position and is ejected after the dummy bar 14 has been divided. Reference numeral 32 denotes a gas cutting machine acting as gas cutting means to cut said continuous cast strand 18, which is guided by said dummy bar 14 for removal, into desired dimensions. Reference numeral 34 denotes a hood as a receiving means to recover sludge such as iron oxide scale generated during gas cutting operation and combustion gases. Reference numeral 36 denotes a guide roller. As will be described in detail hereinafter, gas cutting machine 32 and hood 34 are designed so that processing operations thereof at the time of cutting a work item may be synchronized in order to enhance the recovering efficiency and to provide a compact structure.

Figure 2:
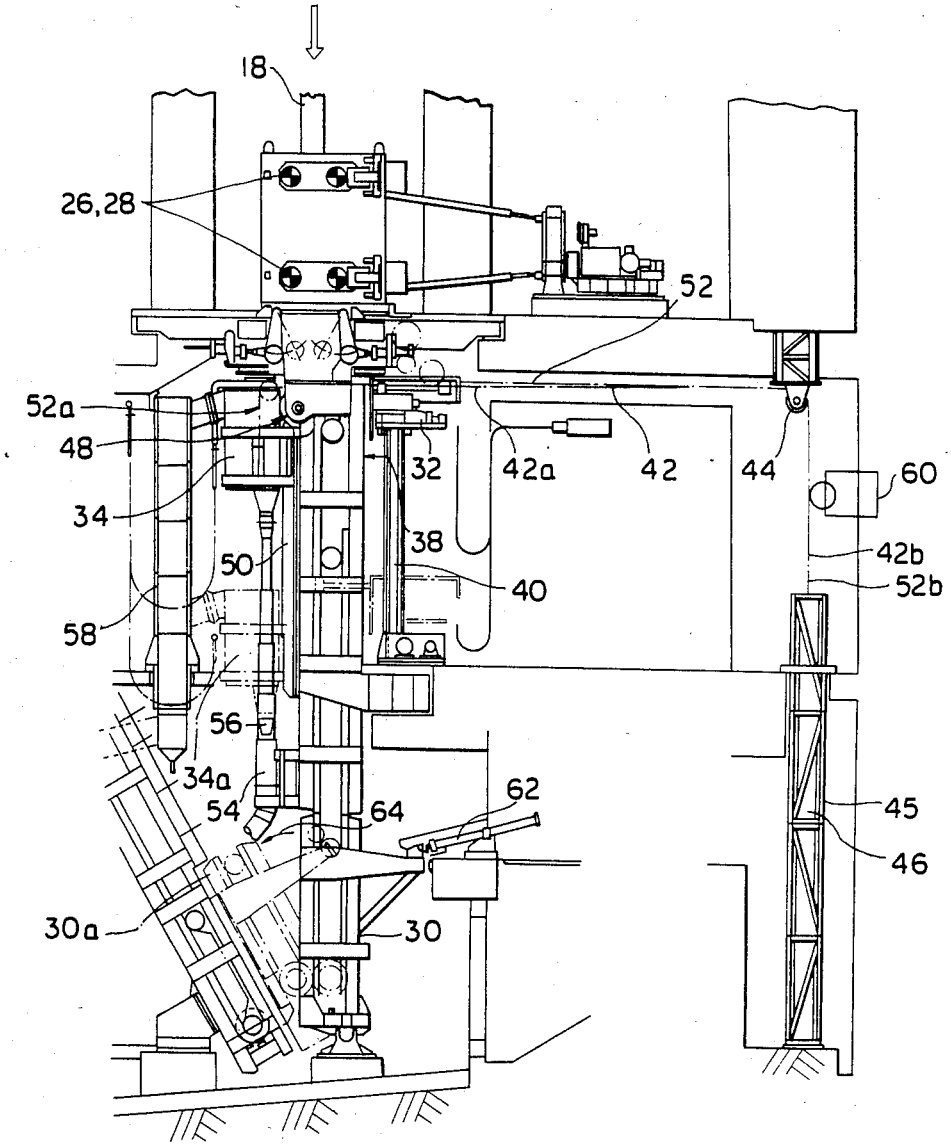
FIG. 2 is a side view showing a lower structure within a caisson of a vertical type continuous casting apparatus with a movable hood mounted thereon.

First, the movable hood for the gas cutting machine will be described. FIG. 2 is a side view of an embodiment of the present invention of a lower portion within a caisson of a vertical type continuous casting apparatus. The continuous cast strand 18 is held by the pulling-out pinch rolls 26 and is vertically moved downwardly continuously while being pulled out of the water-cooled mould 12 by driving of said rolls.

A gas cutting machine 32 such as a well-known gas cutting means in which high pressure oxygen is blown against the high temperature cast strand 18 from a torch 38 is utilized. The gas cutting machine 32 has an arm extended therefrom, said arm being clamped on the cast strand 18 by an air cylinder, and the arm is vertically moved downward along a guide 40 together with a lower end of the cast strand 18 pulled out by the pinch rolls 26 and 28.

Gas cutting is carried out by horizontal movement of the torch 38 during the vertical downward movement of the gas cuttingmachine 32. The gas cutting machine 32 is connected to one end **42*a* of a first wire rope 42 for the gas cutting machine and the other end 42*b* thereof is connected to a balance weight 46 embraced by an embracing tower 45 via a pulley 44. At a position opposite the gas cutting machine 32 with the cast strand 18 located in the center, there is provided a movable hood 34 as a receiving means for opening an opening member 48 in the neighborhood of the torch 38, preferably facing to a blow-out port of the torch. A guide 50 for the movable hood 34 is suspended as illustrated. The movable hood 34 is connected to one end 52*a* of a second wire rope 52 for the movable hood and the other end 52*b* thereof is connected to the balance weight 46 via the pulley 44. That is, a synchronous lifting means is provided which is composed of the wire ropes 42, 52, balance weight 46 and guides 40, 50. By such common use of the lifting mechanism, a device of intensive structure may be obtained. In this manner, the movable hood 34 can be moved up and down in synchronism with vertical movement of the gas cutting machine 32 through upward and downward movement of the balance weight 46 as the gas cutting machine 32 moves up and down. In this way, the movable hood 34 is always moved up and down in synchronism with the gas cutting machine 32, and therefore, the movable hood 34** can be made smaller in opening than that of the conventional fixed hood. Also, the efficiency of collectng sludge is enhanced.

The position **34*a* of downward movement of the movable hood 34 is indicated by chain lines. A telescopic sludge discharging pipe 56 directed towards a sludge reservoir 54 and a flexible telescopic suction duct 58 formed of canvas or the like communicated with a gas suction blower (not shown) are connected to the movable hood 34 so as not to impair upward and downward movement thereof. Reference numeral 60 denotes a driving device such as a motor which is used to return the gas cutting machine 32 and movable hood 34** after the latter have been moved upwardly.

Since the weights of the gas cutting machine 32 and the movable hood 34 are balanced by the balance weight 46, the driving device 60 for moving upward and returning them can be made so as to be small in capacity.

While in the above-described embodiment, in order that the gas cutting machine 32 and movable hood 34 may be synchronized not only for downward movement but upward movement, the other ends **42*b*, 52*b* of the first and second wire ropes 42, 52 are connected to the single balance weight 46** so as to constitute a synchronous lifting means, it will be noted that a simultaneous descending means can be provided in which wire ropes are connected to separate balance weights so that the gas cutting machine and movable hood may be synchronized at least only at the time of downward movement during execution of cutting operation and they are individually moved up at the time of upward movement.

Reference numeral 30 denotes an ejecting device of a tiltable basket type for delivering cut cast strand 18. The ejecting device is tilted as indicated by the arrow 64 by means of a tiltable cylinder 62 and assumes a tilted position **30*a* as indicated by the chain lines, after which each cut cast strand is delivered. In tilting the cut cast strand, the small-sized movable hood 34 is returned to the uppermost position and arranged so the pipe 56 as the sludge discharge means and the duct 58 as the gas suction means may avoid the tilted cast strand. That is, an arrangement is made so as not to be positioned on the ejecting orbit of the cast strand. With this, a lengthy cut cast strand can be ejected without making the upper end thereof contact with the bottom of the uppermost movable hood 34**, and it is not necessary to make the caisson deep and the house high to eject the lengthy cast strand as encountered in prior art devices.

Next, the divisional dummy bar 14 which forms a part of the vertical type continuous casting apparatus in accordance with the present invention will be described.

Figure 3:
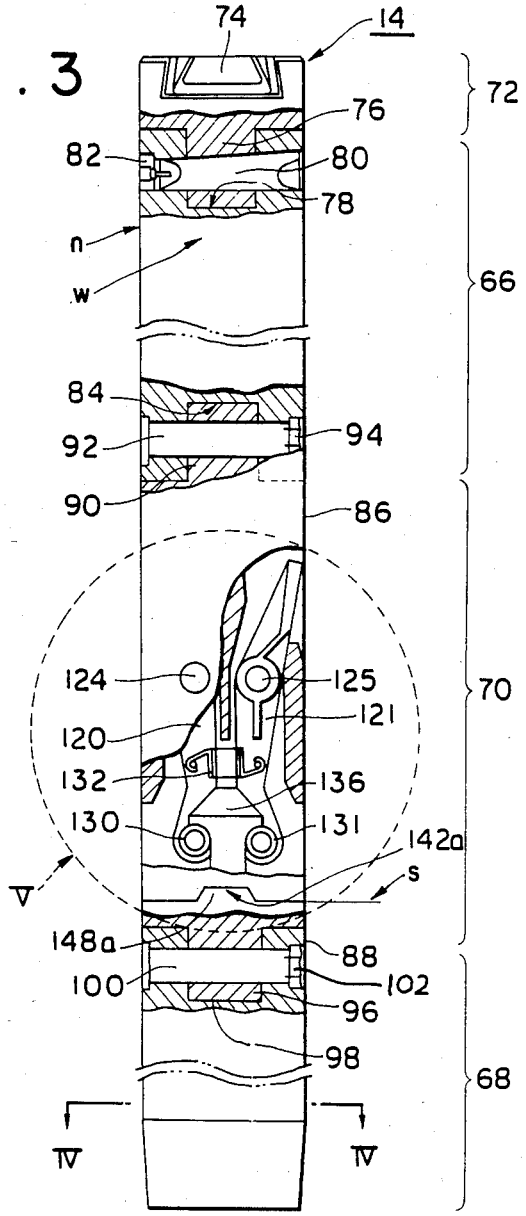
FIG. 3 is a side view partly in section of a divisional dummy bar in which upper and lower dummy bars are connected by connector members.

FIG. 3 is a front view partly in section of the divisional dummy bar 14. This divisional dummy bar 14 comprises an upper divisional dummy bar 66, a lower divisional dummy bar 68 and a connector 70 and head 72 for connecting these divisional dummy bars.

That is, the divisional dummy bar 14 comprises, starting from above, a head 72, an upper divisional dummy bar 66, a connector 70 and a lower divisional dummy bar 68, as shown in FIG. 3.

The head 72 has a fixing portion 74 for molten steel at the upper end thereof and a projection 76 in the central portion at the lower end thereof. The upper divisional dummy bar 66 has a recess 78 for receiving the projection 76 at the upper end, and the projection 76 and recess 78 are connected in male and female relation and locked by a through-cotter member 80 and an end plate 82 so as not to be disengaged. The upper divisional dummy bar 66 is formed at its lower end with a recess 84. The connector 70 comprises an upper member 86 for housing therein an operating portion and a lower member 88 connected to the upper member 86. The upper member 86 has a convex portion 90 at the upper end thereof, said convex portion being connected to the recess 84 of the upper divisional dummy bar 66 and locked by a pin 92 and a plate 94 so as not to be disengaged. On the other hand, the lower member 88 is provided at its lower end with a convex portion 96 and the lower divisional dummy bar 68 is provied at its upper end with a recess 98, both convex portion 96 and recess 98 being locked by a pin 100 and an end plate 102 so as not to be disengaged. The ends of the cotter member 80, and pins 92 and 100 are embedded so as not to project from a wide surface w as an outer surface of the dummy bar 14 and arranged so as not to produce an inconvenience when in use of the dummy bar 14.

Figure 4:
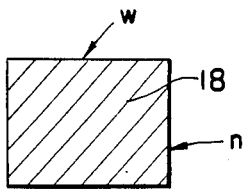
FIG. 4 is a sectional view taken along line IV—IV of FIG. 3.

The cross sectional shape of the continuous cast strand 18 and the divisional dummy bar 14 formed into the same shape as that of the continuous cast strand 18 have a rectangular shape as shown in FIG. 4. The lengthy outer surface of the dummy bar 14 is restricted by the four surfaces of two wide surfaces w and narrow surfaces n. Secondary cooling guide rolls 20, 22, 24 and the pulling-out pinch rolls 26, 28 come into contact with the wide surfaces w.

Figure 6:
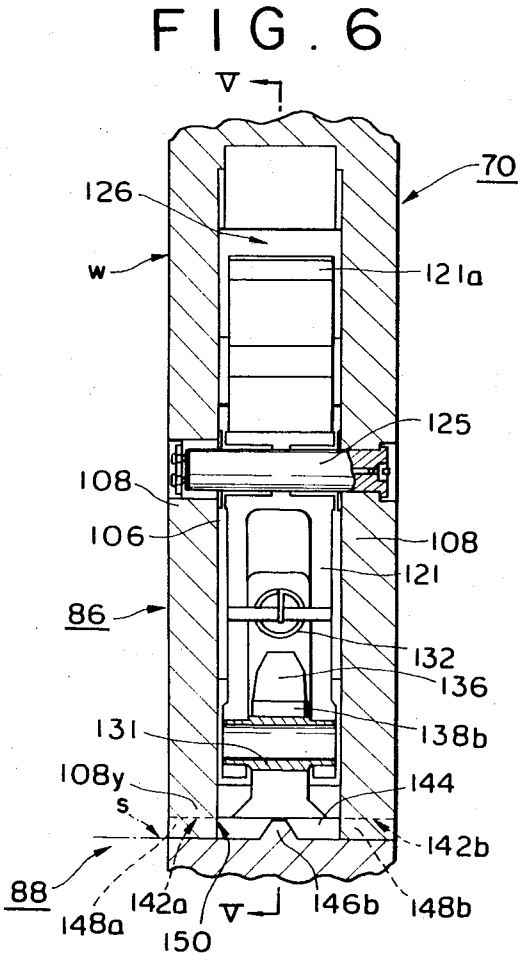
FIG. 6 is an enlarged view taken along line VI—VI of FIG. 5.
Figure 5:
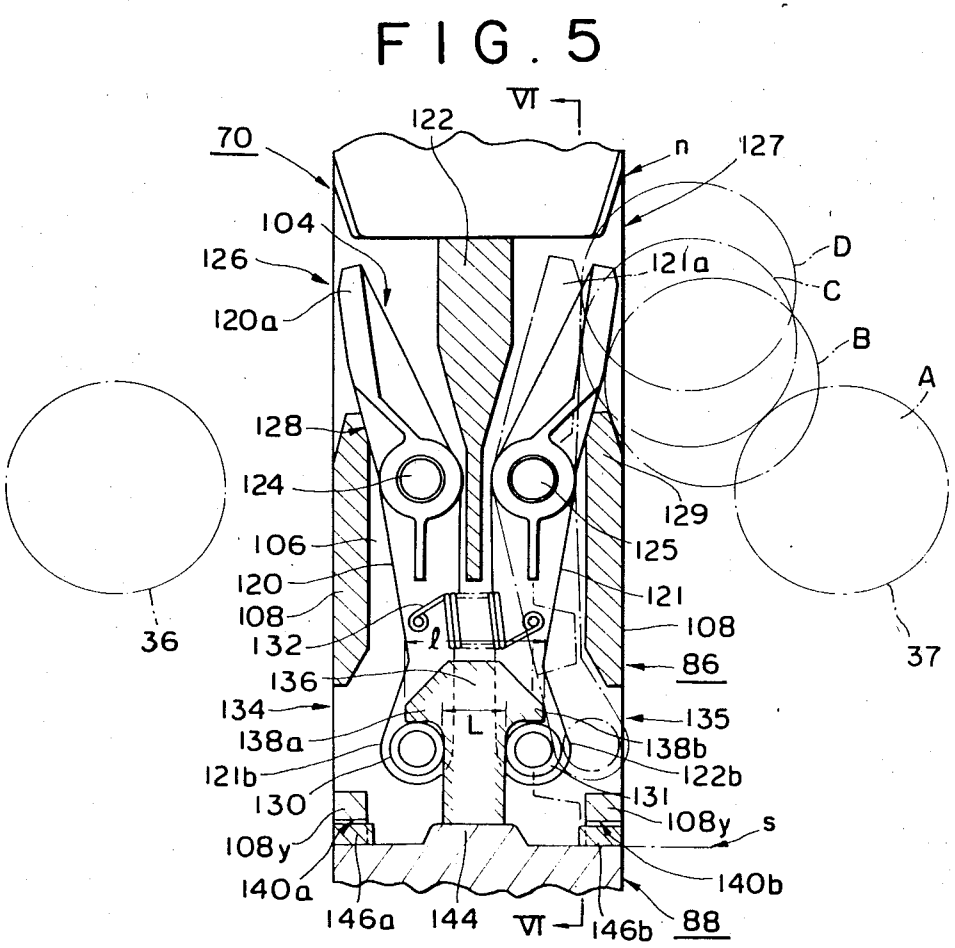
FIG. 5 is an enlarged sectional view taken along line V—V of FIG. 6 in portion V as indicated by the arrow in FIG. 3.

The connector 70 shown in FIGS. 5 and 6 comprises the upper member 86 and lower member 88 as described above.

The upper member 86 is formed with an inner cavity 106 for housing therein a holding and operating mechanism 104 by being encircled by an outer shell 108 forming the wide surface w and narrow surface n. The holding and operating mechanism 104 is constructed as described hereinafter. A pair of levers 120, 121 are opposed with a middle wall 122 suspended in the central portion of the inner cavity 106 sandwiched therebetween, and a substantially central portion of the levers 120, 121 is pivotably supported by lever shafts 124, 125. Upper ends **120*a*, 121*a* of the levers 120, 121 are positioned to face towards upper window portions 126, 127 respectively bored on the side of the narrow surface n. However, one end of the outer shell 108 functions as stoppers 128, 129 so that the upper ends 120*a*, 121*a* may not be projected to the outer surface from the window portions 126, 127. Rollers 130, 131 are rotatably mounted on lower ends 121*b*, 122*b* of the levers 121, 122, respectively. A spring 132 is stretched at a position lower than the lever shafts 124, 125 between the levers 120, 121 to bias the rollers 130, 131 in a direction to move them closer to each other. Lower window portions 134, 135 are provided below the upper window portions 126, 127 to provide the leg opening operation of the rollers 130, 131**.

The lower member 88 is provided at its upper end with a hooking head (connector head) 136, the shape thereof on the side of the wide surface w having a T-shape. The connector 136 has locking shoulders **138*a*, 138*b*** for locking engagement.

First grooves **140*a*, 140*b* (FIG. 5) are provided on the side of the narrow surface n of a lower outer shell 108*y* at the lower end of the upper member 86 and second grooves 142*a*, 142*b* (FIG. 6) are provided on the side of the wide surface w. The upper member 86 is provided at its central portion with a central convex portion 144 parallel to the narrow surface n, whereas the lower member 88 is provided with first convex portions 146*a*, 146*b* and second convex portions 148*a*, 148*b* fitted into the first grooves 140*a*, 140*b* and second grooves 142*a*, 142*b*, respectively, and is formed in its central portion with a central groove 150. Reference character s denotes a separting surface between the upper member 86 and the lower member 88. Centering between the upper member 86 and lower member 88** is accurately performed by the aforesaid grooves and convex portions to prevent occurrence of a difference in step in the separating surface and occurrence of inconveniences at the time of pulling-out.

A pair of guide rollers 36, 37 are provided opposedly on the side of the narrow surface so that they may be moved toward and away from each other, as shown in FIG. 5. By the operation of moving the guide rollers 36, 37 toward and away from each other, the upper ends **120*a*, 121*a* of the levers 120, 121 are pushed so as to open a mutual spacing between the holding rollers 130, 131**.

The divisional dummy bar of the present invention constructed as described above is operated in accordance with the following procedure.

Figure 7:
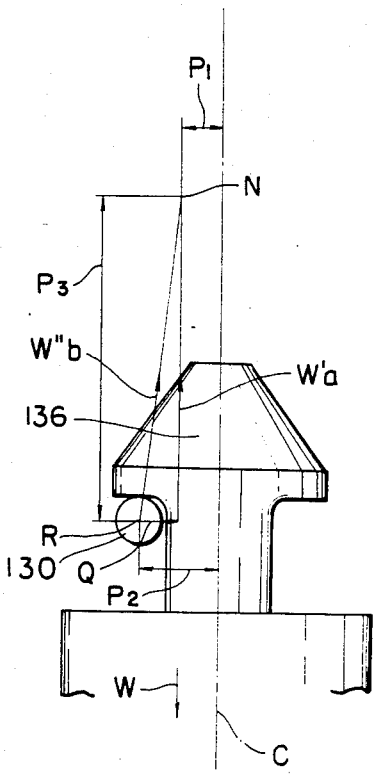
FIG. 7 is a diagram showing the relation of an acting force when the connectors are connected.

That is, when casting begins, a cast strand is pulled out by the pinch rollers 26, 28 under the docking state wherein the upper divisional dummy bars 66, 68 are connected. This docking state is attained by pivotally moving the levers 120, 121 to the position as shown in FIG. 7 and clamping the T-shaped hooking head 136 from both sides through the rollers 130, 131 at the lower ends of the levers 120, 121.

In this clamped position, the distance $P_2$from the center line C of the dummy bar to the center R of the roller 130 is somewhat greater than the distance $P_1$ to the center N of the lever shaft 124, and the line segment RN is inclined in a direction wherein the lower portion thereof is spaced from the center line with respect to the center line of the dummy bar. In this manner, the reaction Wa of the weight W of the lower divisional dummy bar 68 will cause a resultant force with a component of force Wb and centrally directed component of force Q. This component of force Q acts on the direction of a center line as a self-locking force of the roller 130. Therefore, accidental release of the lower divisional dummy bar does not occur, operation is positive and the desired work is easily accomplished. This self-lock force Q is calculated by the following equation:

$$Q = W \times \tan (P_2 - P_1)/P_3$$

where $P_3$ represents the distance between RN. The spring force of the spring 132 acts in the same direction as that of the self-locking force Q but is smaller than the self-locking force.

When the cast strand is pulled out while holding the lower divisional dummy bar 68 within the delivery device of the delivery table and a predetermined level is reached, both guide rollers 36, 37 are moved forward from the waiting position A as indicated by the solid line in FIG. 5 by operation of an actuator (not shown) such as a hydraulic cylinder and come into contact with the outer surface of the connector and the upper ends 120*a*, 121*a* of the levers 120, 121 to separate the upper and lower divisional dummy bars. Here, the position B of the separating surface s of the upper and lower divisional dummy bars 66, 68 is determined by the advancing speed of the narrow surface guide rollers 36, 37, the casting speed and the elevated level of the delivery basket. During further movement of the narrow surface guide rollers 36, 37 to the position C, levers 120, 121 tilt about the lever shafts 124, 125 to separate the upper and lower dummy bars 66, 68. That is, when the distance L between the rollers 130, 131 is greater than the width l of the hooking head, the lower divisional dummy bar 68 becomes free and moves downward by its own weight to rapidly effect separation. The subsequent step of the guide roller 37 moving from position C to position D is effected so as not to impede the aforesaid separation while holding the condition of the stroke end of the hydraulic cylinder for a certain period of time.

While in the foregoing, the present invention has been described of the embodiment of a two divisional type divisional dummy bar, it should be understood that more than three divisional types of divisional dummy bars can be likewise utilized.

What is claimed is:

1. A vertical type continuous casting apparatus, comprising:

gas cutting means having a torch for gas cutting a cast strand, said gas cutting means being movable downwardly together with a cut portion of the cast strand;

movable receiving means open adjacent said torch for receiving sludge and combustion gas;

sludge discharge means for discharging said sludge;

suction means for suctioning combustion gas, said discharge means and said suction means being connected to said receiving means; and synchronous descending means for moving said receiving means downwardly in synchronism with vertical downward movement of said gas cutting means wherein said movable receiving means further comprises a hood forwardly openable opposite a blow-out port of said torch in a blowing direction of said torch.

2. A vertical type continuous casting apparatus according to claim 1, wherein said sludge discharge means further comprises an expansible telescopic type pipe for discharging sludge and said suction means further comprises a suction duct formed of a flexible material.

3. A vertical type continuous casting apparatus according to claim 1, wherein said synchronous descending means further comprises a balance weight, a first wire rope, one end of which is connected to said gas cutting means while an end opposite is connected to said balance weight through a pulley, and a second wire rope, one end of which is connected to the hood while an opposite end is connected to said balance weight through said pulley.

4. A vertical type continuous casting apparatus according to claim 1, further comprising synchronous lifting means for lifting said receiving means in synchronism with both vertical upward and downward movements of said gas cutting means.

5. A vertical type continuous casting apparatus according to claim 1, further comprising tiltable basket type ejecting means for delivering a cut cast strand, said suction means and said sludge discharge means being disposed outside the orbit of the tilting cut cast strand.

6. A vertical type continuous casting apparatus, comprising:

gas cutting means having a torch for gas cutting a cast strand, said gas cutting means being movable downwardly together with a cut portion of the cast strand;

movable receiving means open adjacent said torch for receiving sludge and combustion gas;

sludge discharge means connected to said receiving means for discharging sludge;

suction means connected to said receiving means for suctioning combustion gas;

synchronous descending means for moving said receiving means downwardly in synchronism with vertical downward movement of said gas cutting means;

a dummy bar comprising an upper divisional dummy bar, a lower divisional dummy bar and at least one set of connectors for interconnecting said upper and lower divisional dummy bars, wherein each of said connectors further comprise an upper member and a lower member, said upper member having in an inner cavity portion thereof a pair of levers pivotally supported on lever shafts, said levers each havng a locking roller and having its upper end positioned in a window portion for entry of a guide roller provided on the side of said upper member, and said lower member having a hooking head held by said pair of locking rollers; and means for moving said movable receiving means wherein, when the lower divisional dummy bar is ejected, the receiving means is positionable at an uppermost elevated position to tilt and eject the lower divisional dummy bar and wherein said movable receiving means further comprises a hood forwardly openable opposite a blow-out port of said torch in a blowing direction of said torch.

7. A vertical type continuous casting apparatus according to claim 6, wherein said connector further comprises an engaging shaft connectng said upper member to said upper divisional dummy bar, said engaging shaft being inserted at a right angle with respect to the longitudinal direction of the dummy bar and a coupling shaft for interengaging said lower member with said lower divisional dummy bar, said coupling shaft being inserted at a right angle with respect to the longitudinal direction of the dummy bar.

8. A vertical type continuous casting apparatus according to claim 6, further comprising a spring for biasing the pair of levers to move said levers in a direction such that lower ends thereof are moved towards each other.

9. A vertical type continuous casting apparatus according to claim 6, wherein the upper member and lower member of the connector are joined in a separating surface, said separating surface having recesses and grooves formed therein which are fitted to coaxially couple both said upper and lower members.

10. A vertical continuous casting apparatus according to claim 6, further comprising synchronous lifting means for lifting said receiving means in synchronism with both vertical upward and downward movements of said gas cutting means.

11. A vertical type continuous casting apparatus according to claim 6, further comprising a connector holding and operating mechanism for satisfying the relation $P_2 > P_1$ where $P_1$ represents the distance from a center line of the dummy bar to a center of the lever shaft and $P_2$ represents the distance from the center line of the dummy bar to a center of the roller at the time of docking between the upper member and the lower member of the connector.

12. A vertical type continuous casting apparatus according to claim 6 wherein said sludge discharge means further comprises an expansible telescopic pipe for discharging sludge.

* * * * *